US008047330B1

(12) United States Patent
English

(10) Patent No.: US 8,047,330 B1
(45) Date of Patent: Nov. 1, 2011

(54) TELESCOPING LADDER JACK

(76) Inventor: Jody James English, Battle Creek, MI (US)

( * ) Notice: Subject to any disclaimer, the term of this patent is extended or adjusted under 35 U.S.C. 154(b) by 1190 days.

(21) Appl. No.: 11/321,674

(22) Filed: Dec. 29, 2005

Related U.S. Application Data

(60) Provisional application No. 60/640,446, filed on Dec. 30, 2004.

(51) Int. Cl.
*E06C 1/04* (2006.01)

(52) U.S. Cl. ..... 182/117; 182/121

(58) Field of Classification Search ..... 182/117, 182/82, 121
See application file for complete search history.

(56) References Cited

U.S. PATENT DOCUMENTS 567,755 A * 9/1896 Stillman ..... 248/238
1,359,297 A * 11/1920 Voss ..... 182/207
4,542,874 A 9/1985 Ronning
5,020,757 A 6/1991 Sulecki et al.
5,647,452 A * 7/1997 Gauthier ..... 182/117
6,003,631 A * 12/1999 Knauth ..... 182/82
6,045,102 A 4/2000 Terenzoni

* cited by examiner

*Primary Examiner* — Alvin C Chin-Shue
(74) *Attorney, Agent, or Firm* — Bliss McGlynn, P.C.

(57) ABSTRACT

A telescoping ladder jack supports a scaffolding plank and comprises a main member. A telescoping beam includes longitudinally spaced holes on each side of the telescoping beam and is inserted into or extracted from the main member. A locking mechanism is mounted to the main member and inserted into one of the holes to fix the telescoping beam at a desired length extracted from the main member. Ladder rung hooks are attached to a first bracket, which receives and is pivotally attached to the main member and has one of the hooks attached to each opposing end of the first bracket. A device for adjusting incline includes a second bracket mounted to a bottom of the main member (the second bracket including at least one series of recessed locking joints) and a bracing arm movably fastened to the second bracket by a locking pin oriented through a first end of the bracing arm and pivotally mounted to the first bracket at a second end of the bracing arm. A securing mechanism includes a third bracket mounted to a distal end of the telescoping beam and an adjustable pin that fits into one of the holes in the telescoping beam by passing through a slot in a top of the main member. The slot extends substantially the length of the main member, and the scaffolding plank is secured between the third bracket and adjustable pin to the telescoping beam and main member.

7 Claims, 4 Drawing Sheets

TELESCOPING LADDER JACK

CROSS REFERENCE TO RELATED APPLICATIONS

This Application claims the benefit of Provisional Patent Application Ser. No. 60/640,446, filed Dec. 30, 2004, by the present inventor.

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to devices for extending the distance of a plank used in a scaffolding system away from a structure. In the trade, such devices are commonly referred to as ladder jacks. More specifically, the present invention is a telescoping ladder jack with adjustable scaffold plank lock.

2. Description of the Related Art

Ladder jacks are used by roofers, siders, painters, and others in a trade that requires work on either the face or roof of a structure. Employed when two or more ladders are utilized against a common face of a structure as in a scaffolding system, one ladder jack is attached to each such ladder, at equal heights. The ladder jack typically attaches to the ladder through the use of a hook mechanism. When so attached to two or more ladders at equal heights, the ladder jacks work to offer extension from the structure, via a rigid member that facilitates support of a scaffold plank.

The prior art discloses several devices that may be used as a ladder jack for the support of scaffold planks. As an example, U.S. Pat. No. 5,020,757 (Sulecki et. al) discloses a ladder jack that is attached on the outside of the employed ladders via a hook, is adjustable for varying inclines, and features a threaded bolt, wing nut, and bracket which serves as a stop for the work platform.

Further, U.S. Pat. No. 6,045,102 (Terenzuni), discloses a multiple use tool that combines a roof hook, a roof bracket, and a ladder jack. The device in the Terenzuni patent, when employed as a ladder jack, is utilized on the outside of the employed ladders, locks into horizontal position via a locking mechanism that allows for adjustment for variations in incline, and also features a device to stop the work platform from sliding off the end of the disclosed tool. The Terenzuni patent employs a set of hooks for attachment to two rungs of the employed ladders.

These ladder jacks provide a basic platform for securing a scaffold plank at an elevation. However, these ladder jacks are utilized on the outside of a ladder, thus limiting the range of the worker, and not providing separation between the structure and the ladder, to facilitate working at the higher elevations where the pitch of the ladder narrows considerably. Further, the prior art does not provide for a ladder jack that can be set at varying lengths, and securely lock a scaffold plank of varying widths.

A further example is offered by U.S. Pat. No. 4,542,874 (Rönning), which discloses a bracket for support of a scaffold plank, which may be inverted to be used on the inside of an inclined ladder. The Rönning bracket utilizes one ladder hook and an adjustable arm to accommodate varying inclines.

Thus, there remains a need in the art for a ladder jack that attaches to the inside of the employed ladders, thereby creating a work platform that is closer in relation to the surface upon which work in being performed, that can accommodate variations in incline of the utilized ladder. Further, there is a need for a ladder jack that can be set at varying distances from the working surface but that provides for a means of securing a scaffold plank of varying widths.

BRIEF SUMMARY OF THE INVENTION

Accordingly, the present invention overcomes the disadvantages in the relevant art in a telescoping ladder jack adapted to support a scaffolding plank. The telescoping ladder jack comprises a main member. A telescoping beam includes a plurality of longitudinally spaced holes on each of a plurality of sides of the telescoping beam and is adapted to be inserted into or extracted from the main member. A telescoping beam locking mechanism is mounted to the main member and adapted to be inserted into one of the longitudinally spaced holes to fix the telescoping beam at a desired length extracted from the main member. A plurality of ladder rung hooks are attached to a first bracket, which receives and is pivotally attached to the main member and has one of the ladder rung hooks attached to each opposing end of the first bracket. A device for adjusting incline includes a second bracket mounted to a bottom of the main member (the second bracket including at least one series of recessed locking joints) and a bracing arm movably fastened to the second bracket by a locking pin oriented through a first end of the bracing arm and pivotally mounted to the first bracket at a second end of the bracing arm. A scaffolding plank securing mechanism includes a third bracket mounted to a distal end of the telescoping beam and an adjustable pin that fits into one of the plurality of longitudinally spaced holes in the telescoping beam by passing through a slot in a top of the main member. The slot extends substantially the length of the main member, and the scaffolding plank is secured between the third bracket and adjustable pin to the telescoping beam and main member.

One advantage of the telescoping ladder jack of the present invention is that it employs a plurality of ladder hooks.

Another advantage of the telescoping ladder jack of the present invention is that it includes a means of adjusting the ladder hooks to varying inclines.

A further advantage of the telescoping ladder jack of the present invention is that the ladder hooks may be used to position said telescoping ladder jack on the inside of a ladder.

Another advantage of the telescoping ladder jack of the present invention is that it utilizes a telescoping beam that can be set at varying widths and locked in place.

Still another advantage of the telescoping ladder jack of the present invention is that it includes an adjustable scaffold plank width locking mechanism that can be set at varying lengths and remain set when the telescoping beam is utilized.

A further advantage of the telescoping ladder jack of the present invention is that the ladder hooks may be removeably attached, and when removed and the top ladder hook replaced with a wider top wall plate hook, may allow said telescoping ladder jack to be utilized on the outside of a new construction wall as a scaffold plank support.

Other objects, features, and advantages of the present invention will become apparent from the following descriptions, taken in connection with the accompanying drawings, wherein, by way of illustration and example, an embodiment of the present invention is disclosed.

DETAILED DESCRIPTION OF THE PREFERRED EMBODIMENTS

Referring now to the figures, where like numerals are used to designate like structure, a telescoping ladder jack of the present invention is generally indicated at 10. Said telescoping ladder jack is shown, per se, in FIGS. 1, 2*a*, 2*b*, and 4, and in its operative mode in FIG. 5.

Figure 1:
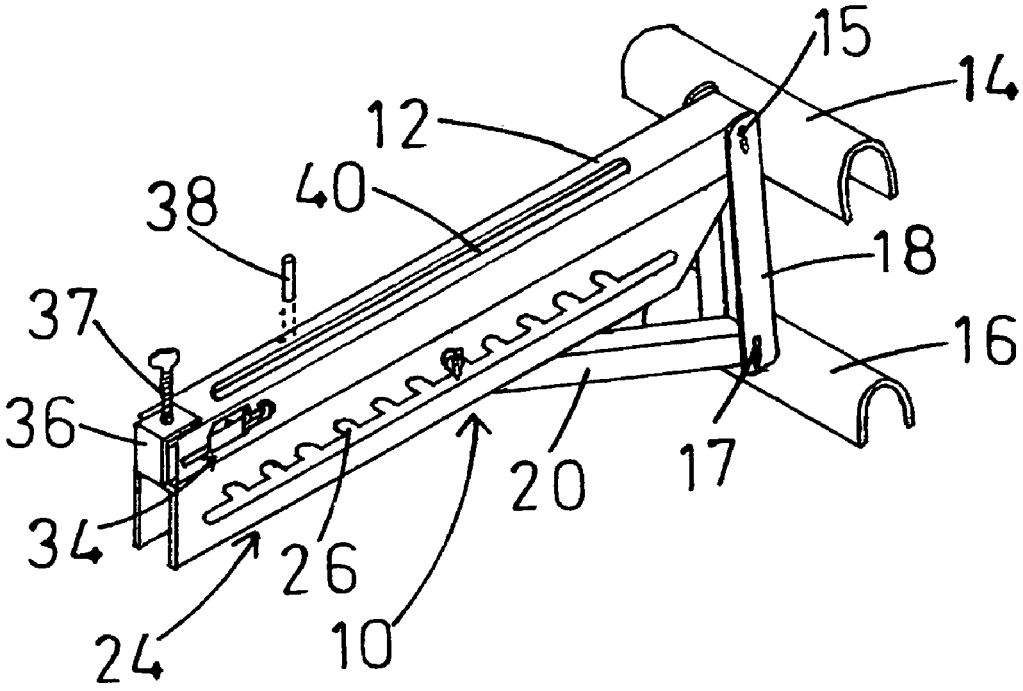
FIG. 1 is a perspective view of the telescoping ladder jack of the present invention, with said telescoping beam in the retracted position.

As is illustrated in FIG. 1, said telescoping ladder jack, 10, includes a ladder jack housing 12 which serves as the main support for a scaffold platform, to which a top ladder hook 14 and a bottom ladder hook 16 are pivotally mounted to said ladder jack housing 12 by a ladder hook bracket 18. Said ladder jack housing 12 is a substantially square and hollow length of metal. Said ladder hook bracket 18 being a substantially U-shaped bracket with said top ladder hook 14 and said bottom ladder hook 16 being fixedly mounted to the outside surface of said ladder hook bracket 18, and the two opposing sides of said ladder hook bracket 18 receiving said ladder jack housing 12 at substantially the top of said ladder hook bracket 18, and being pivotally mounted thereto by a nut and bolt assemblage 15.

In this respect, the telescoping ladder jack 10 of the present invention described herein and detailed in the Figures utilizes a two ladder rung hook configuration. However, it will be apparent to those having ordinary skill in the art that it is possible to utilize any number of ladder rung hooks. Furthermore, the telescoping ladder jack 10 of the present invention may be constructed of any suitable material that can meet safety compliance standards. Finally, it will be apparent to those having skill in the art that said ladder rung hooks 14, 16 may be removeably mounted to said ladder rung hook bracket 18 and may be attached to said ladder jack housing 12 at any suitable point.

FIG. 1 further illustrates that said telescoping ladder jack 10 of the present invention includes an adjustable brace 20, said adjustable brace 20 being a substantially square length of metal pivotally mounted at a first end at substantially the bottom of said ladder hook bracket 18 by a nut and bolt assemblage 17. A second end of said adjustable brace includes a threaded through-bolt 21 that is allowed to pass horizontally through said adjustable brace 20 and engage a wing nut 22 and locking washer 25 on the opposing side of said adjustable brace 20. Said second end of said adjustable brace 20 is received by an incline adjustment locking mechanism, generally indicated at 24. Said incline adjustment locking mechanism 24 being a substantially U-shaped bracket inverted and fixedly attached to the bottom of said ladder jack housing 12. On the two opposing sides of said incline adjustment locking mechanism 24 is a plurality of upwardly extending adjustment slots 26 adapted to engage said threaded through-bolt 21. To adjust the telescoping ladder jack 10 of the present invention to the desired incline, said through-bolt 21 may be inserted into a desired position within said adjustment slots 26, and secured by tightening said wing nut 22 to engage said locking washer 25 against the side of said incline adjustment locking mechanism 24.

It will be apparent to those with skill in the art that said means of adjusting for incline may be accomplished by any suitable means. Furthermore, said incline adjustment locking mechanism 24 may be constructed of any suitable material and may be stamped and bent into shape.

Figure 2A:
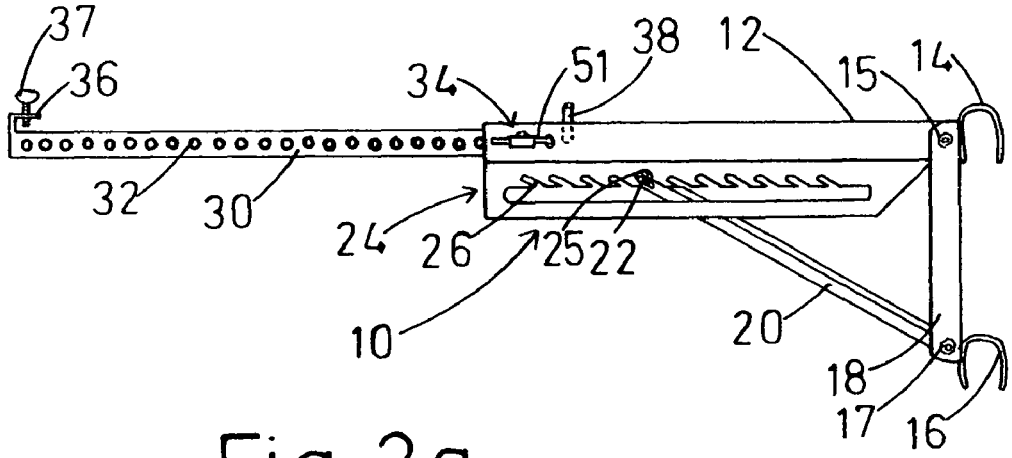
FIG. 2*a* is a side view of the telescoping ladder jack of the present invention, illustrating said telescoping beam in an extended position.
Figure 2B:
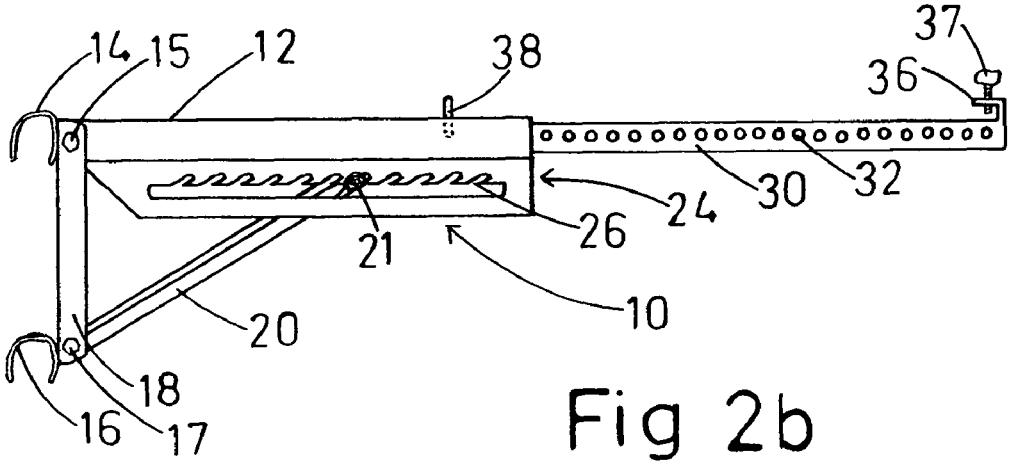
FIG. 2*b* is the opposing side view of FIG. 2*a*, of the telescoping ladder jack of the present invention.

FIGS. 2*a* and 2*b* illustrate the telescoping aspect of the present invention. A telescoping beam 30 may be manually extended from, or retracted into, said ladder jack housing 12. Said telescoping beam 30 being a substantially square length of metal including a plurality of longitudinally spaced holes 32 on each of 4 sides of said telescoping beam 30. A spring latch assembly, generally indicated at 34, is fixedly attached at one side of said ladder jack housing 12, allowing a latch rod 51 to be inserted into one of said longitudinally spaced holes 32, thereby locking said telescoping beam 30 in place.

Figure 3:
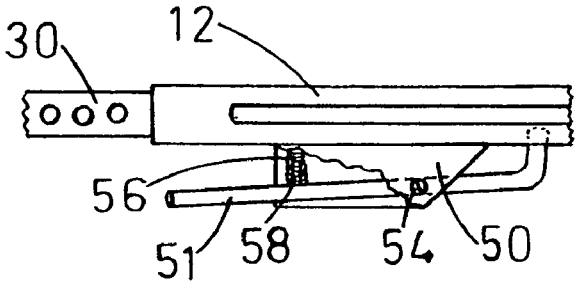
FIG. 3 is a cut-away view of the telescoping beam locking mechanism of the telescoping ladder jack of the present invention.

Said spring latch assembly 34 is further illustrated in FIG. 3. Said latch rod 51, being a substantially round length of metal bent at a substantially right angle at one end, is allowed to pass through a spring latch assembly housing 50 and be pivotally mounted thereto by a pivot screw 54 which passes through the top side of said spring latch assembly housing 50, through said latch rod 51, and through the bottom of said spring latch assembly housing 50. A coil tension spring 56 is fixedly and horizontally mounted to an inside wall of said spring latch assembly housing 50, and is secured to said latch rod 51 by an arm 58 extending off of said latch rod 51 and being inserted through the center of said coil tension spring 56. Said coil tension spring 56 engages said latch rod 51, applying pressure thereto, thereby forcing said latch rod 51 to pivot and allow said latch rod 51 to be secured in place when inserted into one of said longitudinally spaced holes 32 in said telescoping beam 30. It will be apparent to those with skill in the art, however, that said means of locking said telescoping beam 30 may be accomplished by any number of methods, including through-bolt and push-button locking systems.

Figure 4:
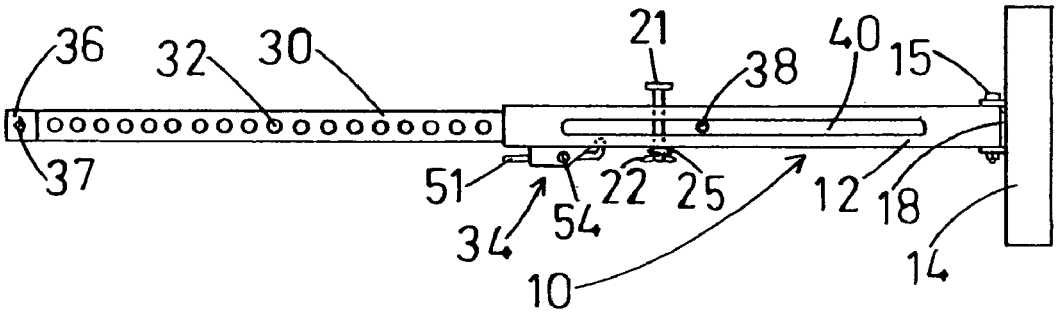
FIG. 4 is a top view of the telescoping ladder jack of the present invention, with said telescoping beam in an extended position.

FIG. 4 further illustrates the mechanism to secure a scaffold platform to said telescoping ladder jack 10. Said means includes a fixed scaffold plank lock 36 fixedly attached to one end of said telescoping beam 30 through which a screw 37 may be threaded, and an adjustable scaffold plank locking pin 38. Said adjustable scaffold plank locking pin 38 being a length of round steel of such diameter so as to allow said adjustable scaffolding plank locking pin 38 to be removeably inserted into one of said plurality of longitudinally spaced holes 32 in said telescoping beam 30, and of such length so as to be longer then the depth of said ladder jack housing 12. Said adjustable scaffold plank locking pin 38 may be removeably placed into one of said plurality of longitudinally spaced holes 32 through a slot 40 in the top side of said ladder jack housing 12. Said slot 40 exposes any number of said plurality of longitudinally spaced holes 32 in any length of said telescoping beam 30 remaining retracted inside said ladder jack housing 12. Used in combination, one operating the telescoping ladder jack 10 of the present invention may set said telescoping beam 30 at the desired length, and secure a scaffolding plank of varying widths to said telescoping beam 30 and ladder jack housing 12 without having to disassemble the telescoping ladder jack 10 to set said adjustable scaffold plank locking pin 38.

Figure 5:
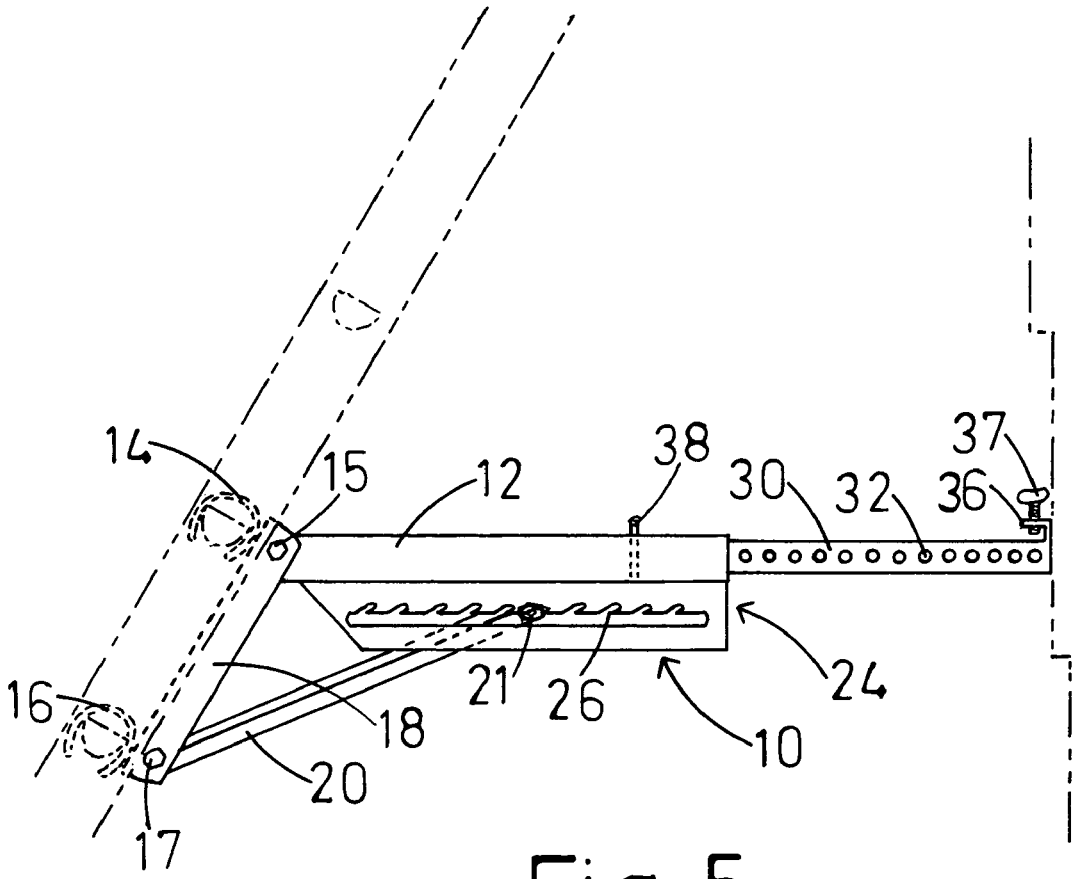
FIG. 5 is a perspective view of the telescoping ladder jack of the present invention mounted on the inside of a ladder.

Referring now to FIG. 5, said top ladder hook 14 and said bottom ladder hook 16, engage rungs of a ladder, securing said telescoping ladder jack 10 in place. Said telescoping ladder jack 10 may then be adjusted using said adjustable brace 20 and incline adjustment locking mechanism 24. Said telescoping beam 30 may then be set to the desired length and a scaffolding plank secured to the exposed telescoping beam 30 and ladder jack housing 12 by employing said fixed scaffold plank lock 36 and said adjustable scaffold plank lock pin 38.

The present invention has been described in an illustrative manner. It is to be understood that the terminology that has been used is intended to be in the nature of words of description, rather than limitation. Many modifications and variations of the present invention are possible in light of the above teachings. Therefore, within the scope of the appended Claims, the invention may be practiced other than as specifically described.

The invention claimed is:

1. A telescoping ladder jack adapted to support a scaffolding plank, said telescoping ladder jack comprising:

a main member;

a telescoping beam including a plurality of longitudinally spaced holes on each of a plurality of sides of said telescoping beam and adapted to be inserted into or extracted from said main member;

a telescoping beam locking mechanism mounted to said main member and adapted to be inserted into one of said longitudinally spaced holes to fix said telescoping beam at a desired length extracted from said main member;

a plurality of ladder rung hooks attached to a first bracket, said first bracket receiving and being pivotally attached to said main member and having one of said ladder rung hooks attached to each opposing end of said first bracket;

a device for adjusting incline including a second bracket mounted to a bottom of said main member, said second bracket including at least one series of recessed locking joints, and a bracing arm movably fastened to said second bracket by a locking pin oriented through a first end of said bracing arm and pivotally mounted to said first bracket at a second end of said bracing arm; and a scaffolding plank securing mechanism including a third bracket mounted to a distal end of said telescoping beam and an adjustable pin that fits into one of said plurality of longitudinally spaced holes in said telescoping beam by passing through a slot in a top of said main member, wherein said slot extends substantially the length of said main member and the scaffolding plank is secured between said third bracket and adjustable pin to said telescoping beam and main member.

2. A telescoping ladder jack as recited in claim 1, wherein said main member is oriented horizontally.

3. A telescoping ladder jack as recited in claim 1, wherein said telescoping beam locking mechanism includes a tension spring and pivotally mounted latch rod adapted to be inserted into said one of said longitudinally spaced holes to fix said telescoping beam at the desired length extracted from said main member.

4. A telescoping ladder jack as recited in claim 1, wherein said first bracket is oriented vertically.

5. A telescoping ladder jack as recited in claim 1, wherein said first bracket is shaped as an inverted "U."

6. A telescoping ladder jack as recited in claim 1, wherein said second bracket is shaped as an inverted "U."

7. A telescoping ladder jack as recited in claim 1, wherein said third bracket defines a hole of said third bracket through which a screw is threaded.

* * * * *